US009869273B2

(12) United States Patent
Kim

(10) Patent No.: US 9,869,273 B2
(45) Date of Patent: Jan. 16, 2018

(54) VANE-ROTOR TYPE STIRLING ENGINE

(71) Applicant: Hyundai Motor Company, Seoul (KR)

(72) Inventor: Won-Gyu Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 155 days.

(21) Appl. No.: 14/945,049

(22) Filed: Nov. 18, 2015

(65) Prior Publication Data

US 2017/0045017 A1 Feb. 16, 2017

(30) Foreign Application Priority Data

Aug. 10, 2015 (KR) ..... 10-2015-0112421

(51) Int. Cl.
*F02G 1/043* (2006.01)

(52) U.S. Cl.
CPC ..... *F02G 1/043* (2013.01); *F02G 2270/10* (2013.01)

(58) Field of Classification Search
CPC .... F02G 1/043; F02G 1/0435; F02G 2270/10; F02C 21/0809
See application file for complete search history.

(56) References Cited

U.S. PATENT DOCUMENTS

| | | | |
|---|---|---|---|
| 7,043,909 | B1 | 5/2006 | Steele |
| 7,171,811 | B1 | 2/2007 | Berchowitz et al. |
| 7,549,289 | B2 | 6/2009 | Herring |
| 9,086,013 | B2 | 7/2015 | Franklin |

FOREIGN PATENT DOCUMENTS

| | | |
|---|---|---|
| JP | 2007-192443 | 8/2007 |
| JP | 2013-60846 | 4/2013 |
| KR | 10-0829957 | 5/2008 |
| KR | 10-2012-0140468 | 12/2012 |

OTHER PUBLICATIONS

Machine translation of KR 20120140468 A, accessed on Jun. 20, 2017.*

* cited by examiner

*Primary Examiner* — Jonathan Matthias
(74) *Attorney, Agent, or Firm* — Brinks Gilson & Lione

(57) ABSTRACT

A Stirling engine includes: a housing for storing a heating medium in an internal space, a rotor eccentrically disposed in the housing and having a plurality of vane slots, a plurality of vanes inserted into the vane slots, a heater for heating the heating medium in the housing, a radiator for cooling the heating medium in the housing, and an output shaft coupled to the rotor so as to output power to the outside. In the Stirling engine, heat absorption portion-side vanes and heat radiation portion-side vanes are installed to the single rotor in the housing, a heat absorption portion and a heat radiation portion are formed in a single enclosed space in the housing, and the heating medium continuously undergoes isothermal expansion and isothermal compression under a constant volume, thereby generating power.

8 Claims, 14 Drawing Sheets

VANE-ROTOR TYPE STIRLING ENGINE

CROSS-REFERENCE TO RELATED APPLICATIONS

The present application claims the benefit of Korean Patent Application No. 10-2015-0112421, filed on Aug. 10, 2015, which is incorporated herein by reference in its entirety.

FIELD

The present disclosure relates to a vane-rotor type Stirling engine and, particularly to an engine that converts thermal energy into kinetic energy.

BACKGROUND

The statements in this section merely provide background information related to the present disclosure and may not constitute prior art.

Stirling engines refer to external combustion engines that convert thermal energy into kinetic energy by sealing a heating medium, such as hydrogen or helium, in an enclosed space, and compressing and expanding the heating medium at different temperatures.

Stirling engines have high thermal efficiency in theory of thermodynamics, and do not have an explosion stroke during combustion. Thus, these Stirling engines have lower vibration and noise, compared to conventional internal combustion engines. In addition, these Stirling engines have an advantage of utilizing all heat sources, such as wood fuel, factory waste heat, and solar heat, as well as petroleum, natural gas, and fossil fuel.

The principle of Stirling engines is known to be designed by Stirling, a British minister in 1816. However, the Stirling engines didn't come into the spotlight due to the rapid development of steam engines and internal combustion engines. In recent years, the Stirling engines have, however, received attention again since heat-resistant material and sealing techniques are newly developed and the importance of energy saving and alternative energy is emphasized.

As these Stirling engines, there are known an α-Stirling engine as illustrated in U.S. Pat. No. 7,171,811 (Feb. 6, 2007), a β-Stirling engine as described in U.S. Pat. No. 7,043,909 (May 16, 2006), etc. FIGS. 9 and 10 illustrate the shapes and driving methods of an α-Stirling engine and a β-Stirling engine, respectively. In the α-Stirling engine, a displacer is not provided therein, two respective pistons 1 and cylinders 2 are arranged to have a phase difference of 90°, and a heating medium 3 moves between a heat radiation cylinder and a heat absorption cylinder, as illustrated in FIG. 9. In the β-Stirling engine, a piston 1 and a displacer 4 are coaxially located, and the heating and cooling times of a heating medium 3 are adjusted by the displacer 4 so that a heat radiation function and a heat absorption function are performed according to the position of the piston in a single cylinder 2, as illustrated in FIG. 10.

However, we have discovered that the piston reciprocates in reciprocating type Striling engines such as the α-Stirling engine and the β-Stirling engine, vibration and noise are generated during the operation thereof. In addition, the heating medium may be leaked from the contact portion between the piston and the cylinder, and complicated driving mechanisms, such as pistons, cylinders, connecting rods, and cranks, are required. For this reason, manufacturing costs are increased and it is difficult to minimize engines.

SUMMARY

The present disclosure provides a Stirling engine capable of suppressing a loss of a heating medium due to vibration and friction, being manufactured at low cost, and having a small size.

The present disclosure can be understood by the following description, and become apparent with reference to the forms of the present disclosure.

In one form of the present disclosure, a Stirling engine includes a housing for storing a heating medium in an internal space, a rotor eccentrically disposed in the housing and having a plurality of vane slots, a plurality of vanes inserted into the vane slots, a heater for heating the heating medium in the housing, a radiator for cooling the heating medium in the housing, and an output shaft coupled to the rotor so as to output power to the outside.

In the Stirling engine, the internal space of the housing is configured of a heat absorption portion as a space in which the heating medium is heated, and a heat radiation portion as a space in which the heating medium is cooled. The plurality of vanes include heat absorption portion-side vanes configured such that one end of each of the heat absorption portion-side vanes is inserted into each of the vane slots, and the other end thereof comes into contact with an inner surface of the housing forming the heat absorption portion during rotation of the rotor, and heat radiation portion-side vanes configured such that one end of each of the heat radiation portion-side vanes is inserted into each of the vane slots, and the other end thereof comes into contact with the inner surface of the housing forming the heat radiation portion during rotation of the rotor.

In the Stirling engine, when the rotor rotates, the heating medium is expanded and heated in the heat absorption portion so as to be isothermally expanded, radiates heat under constant volume while moving from heat absorption portion to the heat radiation portion, is compressed and cooled in the heat radiation portion so as to be isothermally compressed, and absorbs heat under constant volume while moving from the heat radiation portion to the heat absorption portion, thereby allowing power to be generated for rotation of the output shaft.

In one form, the housing may include a heat absorption portion-side outer housing having a first hole forming the heat absorption portion, a heat radiation portion-side outer housing having a second hole forming the heat radiation portion, and outer housings for respectively covering the first and second holes from the outsides. The heat absorption portion-side outer housing may come into contact with the heat radiation portion-side outer housing such that the heat absorption portion directly communicates with the heat radiation portion. When the rotor rotates, the other ends of the heat absorption portion-side vanes may come into contact with a wall surface of the first hole, and the other ends of the heat radiation portion-side vanes may come into contact with a wall surface of the second hole.

In another form, shapes of first and second holes may be determined such that the rotor is eccentrically disposed in the heat absorption portion and the heat radiation portion.

In still another form, the heat absorption portion-side vanes and the heat radiation portion-side vanes may be inserted into the same vane slots formed in the rotor.

The heater may transfer heat to the heating medium through the outer housing for covering the heat absorption portion-side outer housing, and the radiator may radiate heat from the heating medium through the outer housing for covering the heat radiation portion-side outer housing.

In another form, the first and second holes may be arranged to have a predetermined phase angle difference.

In still another form, each of the heat absorption portion-side outer housing, the heat radiation portion-side outer housing, and the outer housings may have a plate shape, and the plate-shaped heat absorption portion-side outer housing and heat radiation portion-side outer housing may be stacked between the plate-shaped outer housings.

In other form, the rotor may be configured in such a manner that a heat absorption portion-side rotor, into which the heat absorption portion-side vanes are inserted, a heat radiation portion-side rotor into which the heat radiation portion-side vanes are inserted, and a shaft connecting the heat absorption portion-side rotor to the heat radiation portion-side rotor are formed integrally with one another. The heat absorption portion-side rotor may have a first groove formed therein such that one end of the first groove communicates with the heat absorption portion, the heat radiation portion-side rotor may have a second groove formed therein such that one end of the second groove communicates with the heat radiation portion, and the shaft may have a third groove communicating with the other ends of the first and second grooves. Accordingly, when the heating medium radiates heat under constant volume and absorbs heat under constant volume, the heating medium may move between the heat absorption portion and the heat radiation portion through a passage formed by the first, second, and third grooves.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
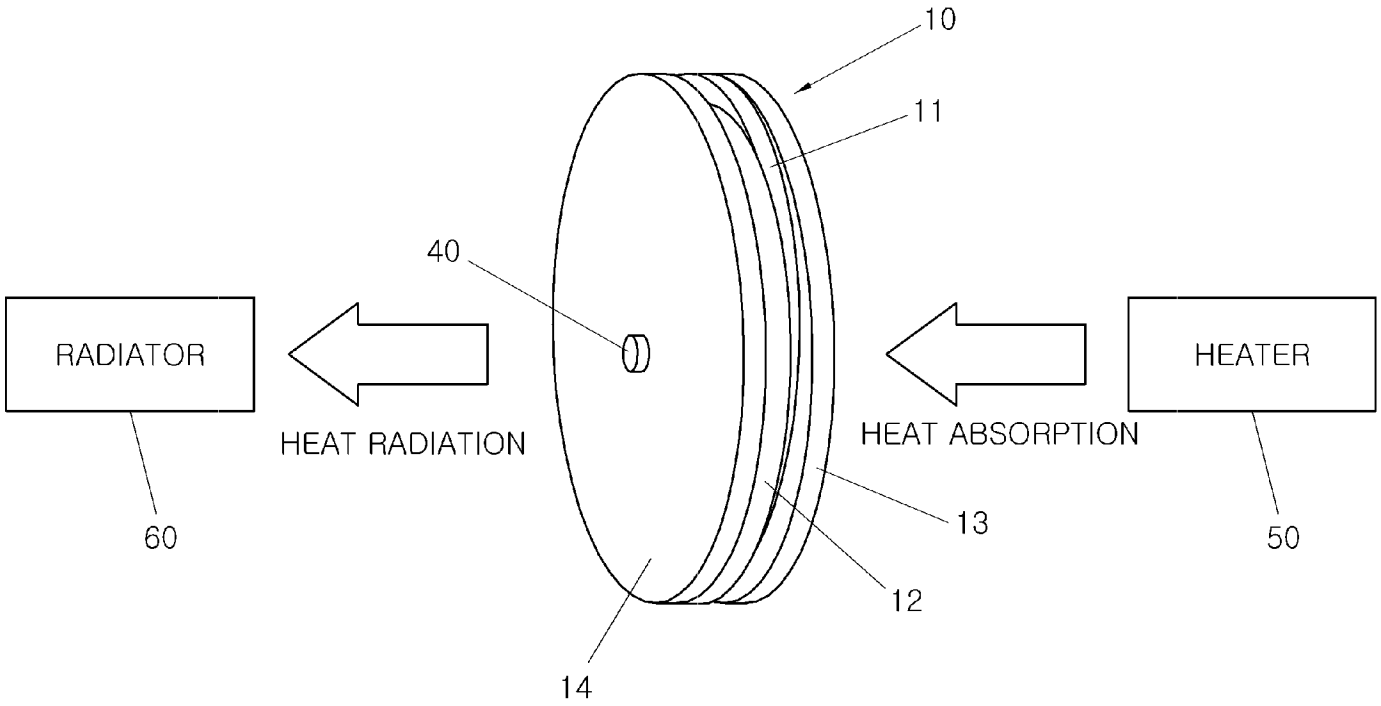
FIG. 1 is a perspective view schematically illustrating a Stirling engine according to one form of the present disclosure when viewed from the outside.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
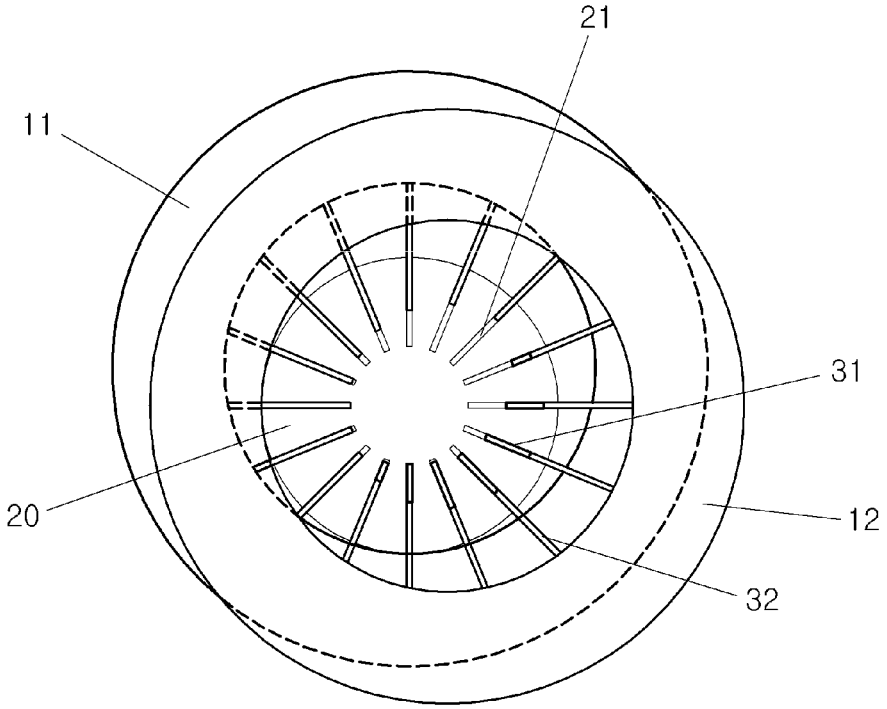
FIG. 2 is a radially cut view of the Stirling engine according to the present disclosure.
Figure 3A:
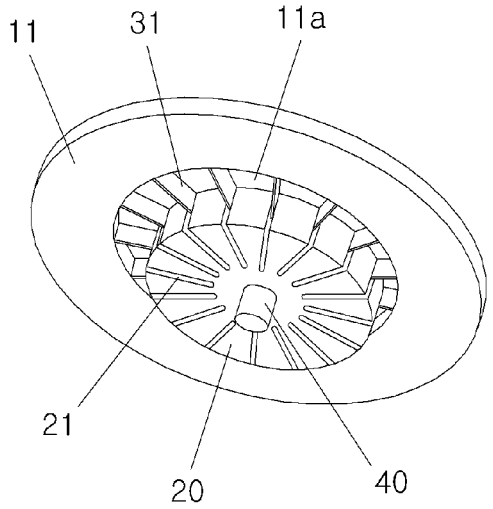
FIG. 3A to FIG. 3C are reference view illustrating individual components constituting a housing of the Stirling engine according to the form of the present disclosure.
Figure 3B:
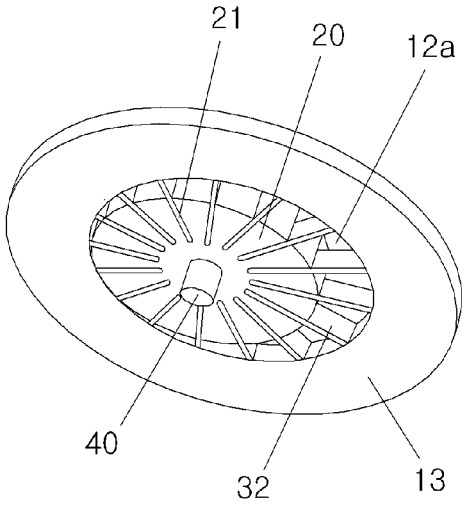
Figure 3C:
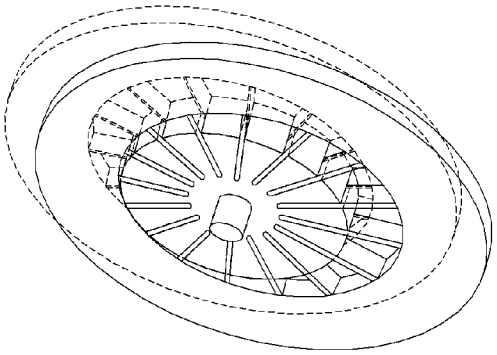

FIG. 1 is a perspective view schematically illustrating a Stirling engine according to one form of the present disclosure when viewed from the outside. FIG. 2 is a radially cut view of the Stirling engine. FIG. 3A to FIG. 3C are a reference view illustrating individual components constituting a housing of the Stirling engine.

The configuration of the Stirling engine according to the form of the present disclosure will be described below with reference to FIGS. 1 to 3.

The Stirling engine includes a housing 10, a rotor 20 which is eccentrically disposed in the housing 10 and has a plurality of vane slots 21, a plurality of vanes 31 and 32 inserted into the vane slots 21, a heater 50 for heating a heating medium 70 in the housing 10, a radiator 60 for cooling the heating medium 70 in the housing, and an output shaft 40 coupled to the rotor 20 so as to output power to the outside.

In the Stirling engine having the above structure, the heating medium 70 stored in the enclosed space in the housing 10 undergoes isothermal expansion-constant volume heat radiation-isothermal compression-constant volume heat absorption processes by the continuous rotation of the rotor 20, which is eccentrically disposed in the housing 10, and thus power is generated so that the output shaft connected to the rotor is rotated. Through this process, the power may be generated without complicated components such as pistons, cylinders, and connecting rods.

FIG. 1 illustrates the housing 10 of the Stirling engine according to one form of the present disclosure. The housing 10 includes a heat absorption portion-side outer housing 11, a heat radiation portion-side outer housing 12, and outer housings 13 and 14 which cover the heat absorption portion-side outer housing 11 and the heat radiation portion-side outer housing 12 from the outsides, respectively.

That is, the outer housing 13, the heat absorption portion-side outer housing 11, the heat radiation portion-side outer housing 12, and the outer housing 14 are stacked in this order in the direction toward the radiator 60 from the heater 50, as illustrated in FIG. 1.

As illustrated in FIGS. 2 and 3, the heat absorption portion-side outer housing 11 and the heat radiation portion-side outer housing 12 are plate-shaped members, and have a first hole 11*a* and a second hole 12*a* which pass through the respective vicinities of the centers thereof. The heating medium 70, which is stored inside the first hole 11*a* formed in the heat absorption portion-side outer housing 11, receives heat generated by the heater 50 through the outer housing 13 to be heated. That is, the first hole 11*a* functions as a heat absorption portion space. In addition, the heating medium 70, which is stored inside the second hole 12*a* formed in the heat radiation portion-side outer housing 12, radiates heat to the radiator 60 through the outer housing 14. That is, the second hole 12*a* functions as a heat radiation portion space.

As illustrated in FIGS. 2 and 3, the shapes of the first and second holes 11*a* and 12*a* are determined such that the rotor 20 is eccentrically disposed in each of the first and second holes 11*a* and 12*a*. Thereby, the heating medium 70 may be compressed and expanded by the vanes 31 and 32 in a heat absorption portion and a heat radiation portion during the rotation of the rotor 20.

As illustrated in FIGS. 2 and 3, the rotor 20 has the plurality of vane slots 21 which axially extend and are installed along the outer peripheral surface thereof. On the basis of the axial direction of the vane slots 21, the heat absorption portion-side vanes 31 are installed to the heat absorption portion, and the heat radiation portion-side vanes 32 are installed to the heat radiation portion.

As illustrated in FIG. 3A, one end of each of the heat absorption portion-side vanes 31 is inserted into the associated vane slot 21 of the rotor 20, and the other end thereof comes into contact with the wall surface of the first hole 11*a* forming the heat absorption portion during the rotation of the rotor 20. In addition, as illustrated in FIG. 3B, one end of each of the heat radiation portion-side vanes 32 is inserted into the associated vane slot 21 of the rotor 20, and the other end thereof comes into contact with the wall surface of the second hole 12*a* forming the heat radiation portion during the rotation of the rotor 20.

In one form, an elastic body such as a spring or a positioning ring may be provided between the associated vane slot 21 and one end of each vane, such that the other ends of the heat absorption portion-side vanes 31 and the heat radiation portion-side vanes 32 may come into close contact with the wall surfaces of the first and second holes 11*a* and 12*a* during the rotation of the rotor 20.

Through the eccentric arrangement of the rotor 20 and the arrangement of the vanes, the heating medium 70 may be expanded and compressed in the respective heat absorption portion and heat radiation portion by the heat absorption portion-side vanes 31 and the heat radiation portion-side vanes 32 during the rotation of the rotor 20.

As illustrated in FIGS. 2 and 3, the heat absorption portion-side outer housing 11 comes into contact with the heat radiation portion-side outer housing 12, such that the first hole 11*a* forming the heat absorption portion is deviated from the second hole 12*a* forming the heat radiation portion when viewed from the side. Thus, when the heating medium 70 is substantially expanded in the heat absorption portion during the continuous rotation of the rotor 20, the heating medium 70 may move from the heat absorption portion to the heat radiation portion. Similarly, when the heating medium 70 is substantially compressed in the heat radiation portion during the continuous rotation of the rotor 20, the heating medium 70 may move from the heat radiation portion to the heat absorption portion.

To this end, FIGS. 2 and 3(*c*) illustrate that the heat absorption portion-side outer housing 11 comes into contact with the heat radiation portion-side outer housing 12 in the state in which the central axes thereof are deviated from each other, and thus the first and second holes 11*a* and 12*a* having the same circular cross-sectional shape come into contact with each other at a predetermined phase angle difference. However, the present disclosure is not limited thereto. For example, the first and second holes 11*a* and 12*a* may have any cross-sectional shape such as an oval shape so long as they have a predetermined phase angle difference.

The outer housing 13 and 14 cover the respective first and second holes 11*a* and 12*a*, which are respectively formed in the heat absorption portion-side outer housing 11 and the heat radiation portion-side outer housing 12, from the outsides, thereby serving to seal the inside of the housing 10. In addition, the outer housing 13 and 14 serve together to transfer heat from the heater 50 to the heating medium 70 in the heat absorption portion and to discharge the heat of the heating medium 70 to the radiator 60.

The output shaft 40 illustrated in FIG. 1 is coaxially connected to the rotor 20 disposed in the housing 10, and protrudes to the outside through the outer housings 13 and 14 for transfer of power.

FIG. 4A to FIG. 4D illustrate the driving operation of the Stirling engine for generation of power according to the present disclosure. The heating medium 70 stored between the heat absorption portion-side vanes 31 is heated and simultaneously expanded in the heat absorption portion by the heater 50, so as to be isothermally expanded (see FIG. 4A). Next, the heating medium 70 is substantially expanded according to the continuous rotation of the rotor 20. In this case, a portion of the heating medium 70 begins to move from the heat absorption portion to the heat radiation portion, thereby allowing the heating medium 70 to radiate heat under constant volume (see FIG. 4B). The heating medium 70 moved to the heat radiation portion is compressed between the heat radiation portion-side vanes 32 and simultaneously radiates heat to the radiator 60 according to the continuous rotation of the rotor 20, so as to be isothermally compressed (see FIG. 4C). Next, the heating medium 70 is substantially compressed according to the continuous rotation of the rotor 20. In this case, a portion of the heating medium 70 begins to move from the heat radiation portion to the heat absorption portion, thereby allowing the heating medium 70 to absorb heat under constant volume (see FIG. 4D).

As such, the heating medium continuously undergoes the isothermal expansion-constant volume heat radiation-isothermal compression-constant volume heat absorption processes so that power is generated, and thus the power may be transferred to the outside through the output shaft 40 which is coaxially connected to the rotor 20.

Figure 5A:
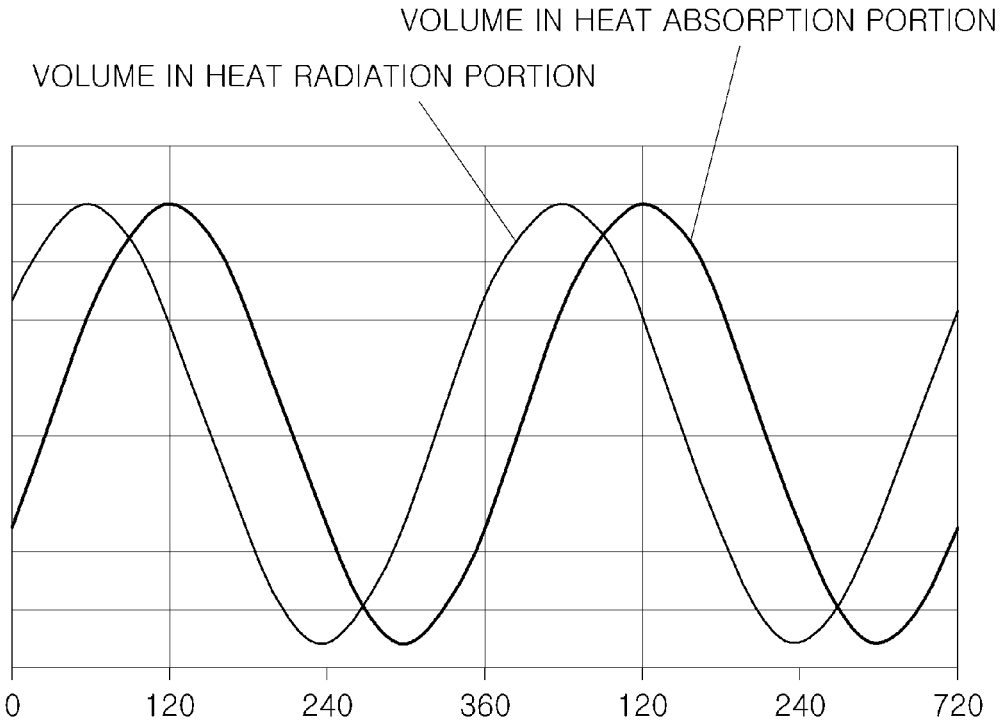
FIG. 5A and FIG. 5B are graphs for comparing a change in volume of a heating medium between the Stirling engine.
Figure 5B:
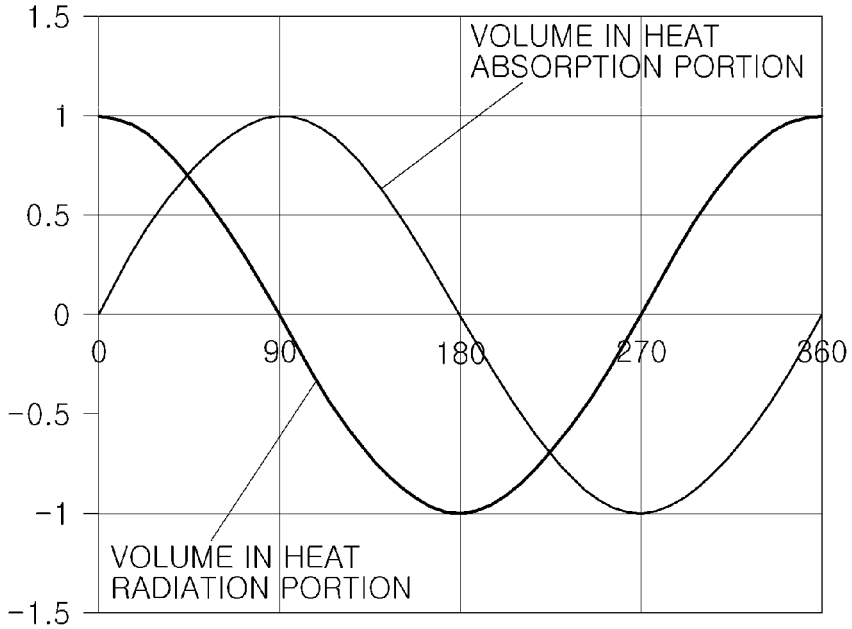
FIG.5B(Prior Art)

FIG. 5A is a graph illustrating a change in volume of the heating medium in the heat absorption portion and the heat radiation portion according to the rotational phase of the Stirling engine of the present disclosure. FIG. 5B is a graph illustrating a change in volume of a heating medium in a heat absorption portion and a heat radiation portion according to the rotational phase of a conventional reciprocating type Stirling engine.

Figure 6A:
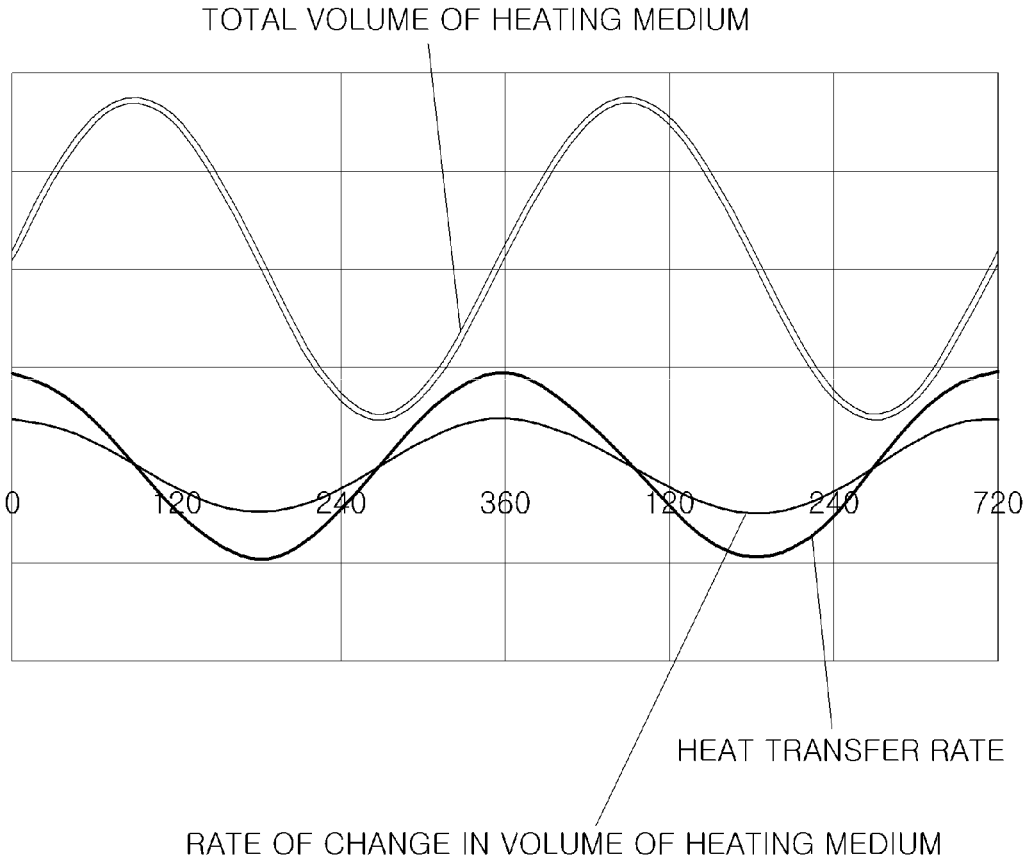
FIG. 6A and FIG. 6B are graphs for comparing a change in heat transfer rate of the heating medium between the Stirling engine.
Figure 6B:
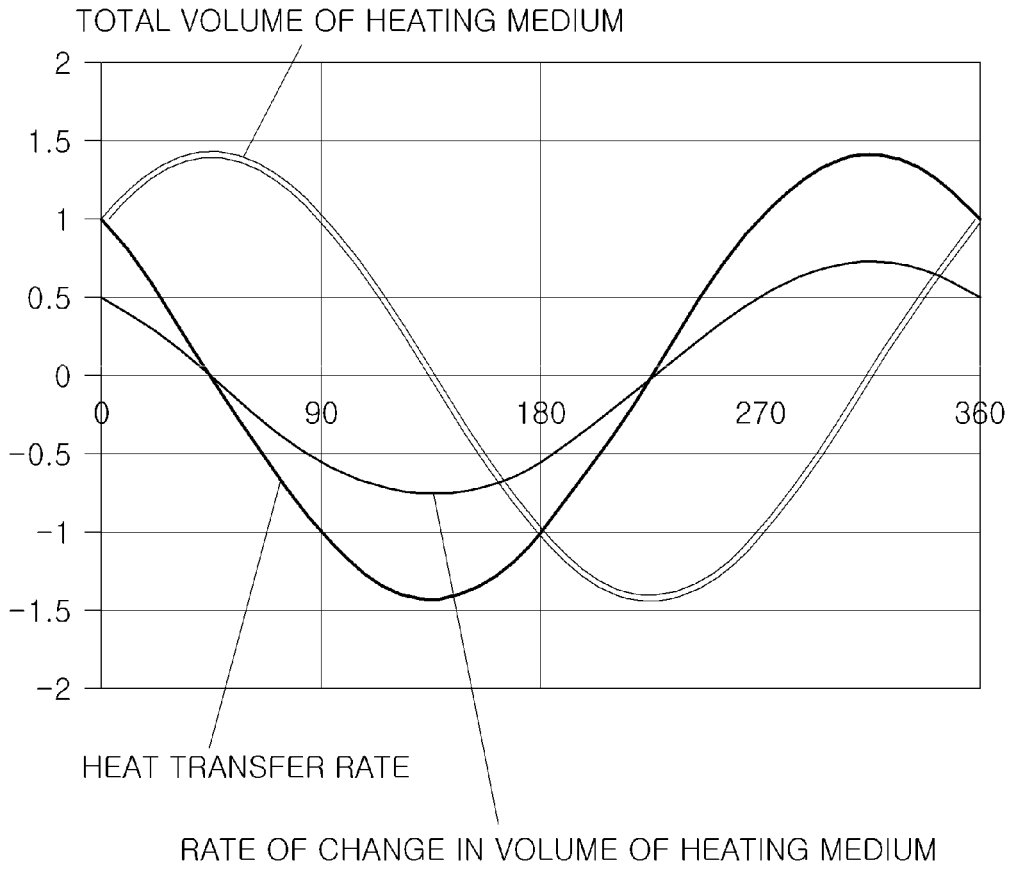
FIG.6B(Prior Art)

Meanwhile, FIG. 6A is a graph illustrating a change in volume of the heating medium and a change in heat transfer rate according to the rotational phase of the Stirling engine of the present disclosure. FIG. 6B is a graph illustrating a change in volume of a heating medium and a change in heat transfer rate according to the rotational phase of the conventional reciprocating type Stirling engine.

As seen from the comparison result in FIGS. 5 and 6, the Stirling engine of the present disclosure may realize the same pattern operation as the existing reciprocating type Stirling engine.

Figure 7:
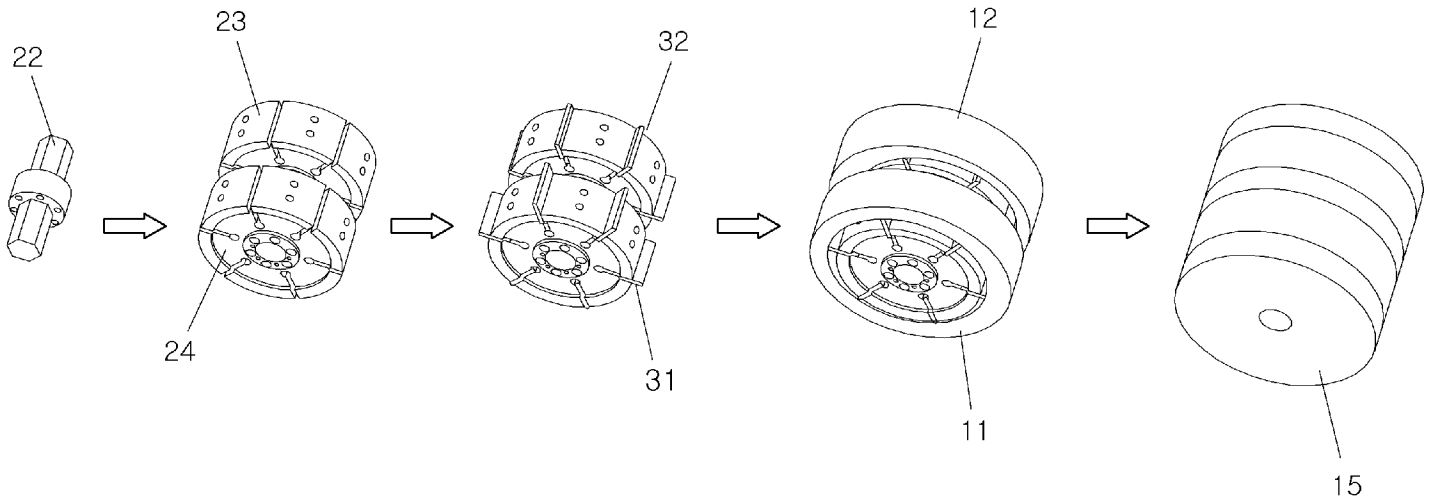
FIG. 7 is an exploded assembly view schematically illustrating individual components constituting a Stirling engine.
Figure 8:
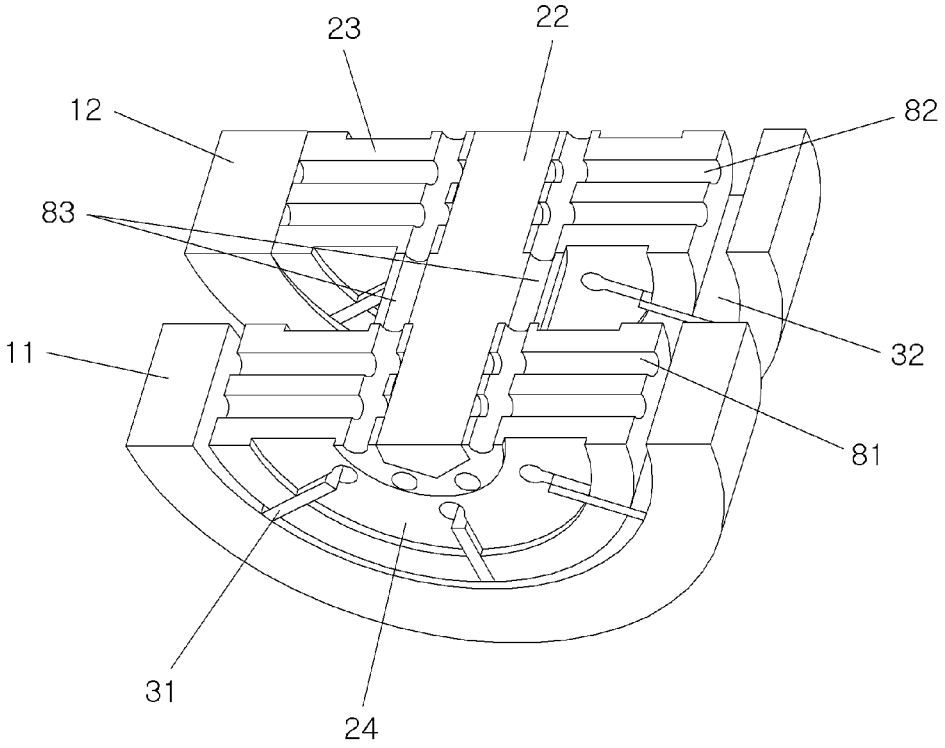
FIG. 8 is a radially cut view of the Stirling engine.
Figure 9:
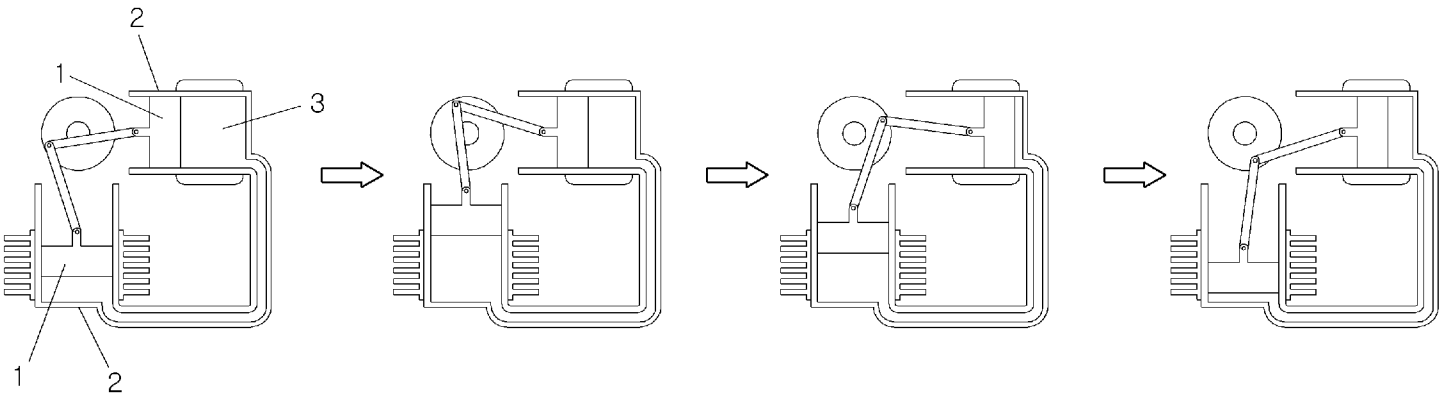
FIG.9 (Prior Art)
FIG. 9 is a reference view illustrating the operation of a α-Stirling engine.
Figure 10:
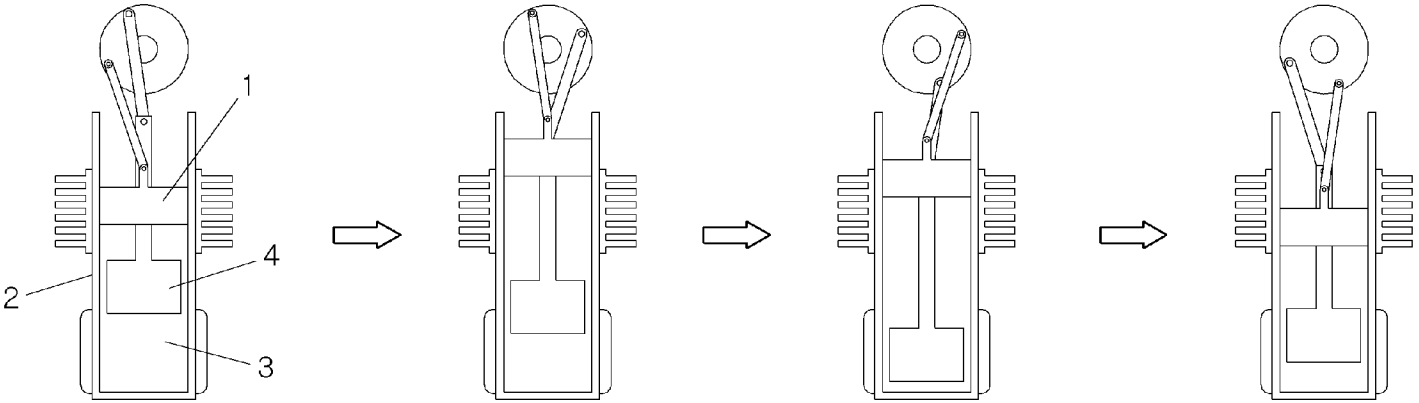
FIG. 10 (Prior Art)
FIG. 10 is a reference view illustrating the operation of a β-Stirling engine.

FIG. 7 is an exploded assembly view schematically illustrating individual components constituting a Stirling engine. FIG. 8 is a radially cut view of the Stirling engine. Hereinafter, a difference between the present form and the above form illustrated in FIGS. 1 to 4 will be described with reference to FIGS. 7 and 8.

In accordance with the Stirling engine illustrated in FIGS. 7 and 8, a rotor is configured in such a manner that a heat absorption portion-side rotor 24 into which heat absorption portion-side vanes 31 are inserted, a heat radiation portion-side rotor 23 into which heat radiation portion-side vanes 32 are inserted, and a shaft 22 which connects the heat absorption portion-side rotor 24 to the heat radiation portion-side rotor 23, are integrally interconnected.

In another form, the heat absorption portion-side rotor 24 and the heat radiation portion-side rotor 23 are cylindrical members which have respective insertion holes formed at the center portions thereof such that one side end portion of the shaft 22 may be inserted into the insertion holes. The heat absorption portion-side rotor 24 and the heat radiation portion-side rotor 23 have a plurality of vane slots formed in the circumferential direction thereof for insertion of the respective heat absorption portion-side vanes 31 and heat radiation portion-side vanes 32.

The shaft 22 axially extends between the heat absorption portion-side rotor 24 and the heat radiation portion-side rotor 23, and one end and the other end thereof are respectively inserted into the heat absorption portion-side rotor 24 and the heat radiation portion-side rotor 23. One end or the other end of the shaft 22 is connected to an output shaft, which is not illustrated in FIGS. 7 and 8, so that power generated by the Stirling engine is output through the output shaft.

The Stirling engine includes a heat absorption portion-side outer housing 11 and a heat radiation portion-side outer housing 12 which respectively cover the outer peripheries of the heat absorption portion-side rotor 24 and the heat radiation portion-side rotor 23. Accordingly, a heat absorption portion is formed between the outer peripheral surface of the heat absorption portion-side rotor 24 and the inner peripheral surface of the heat absorption portion-side outer housing 11, and a heat radiation portion is formed between the outer peripheral surface of the heat radiation portion-side rotor 23 and the inner peripheral surface of the heat radiation portion-side outer housing 12.

As illustrated in FIG. 8, the heat absorption portion-side rotor 24 has a first groove 81 formed therein such that one end of the first groove 81 communicates with the heat absorption portion, the heat radiation portion-side rotor 23 has a second groove 82 formed therein such that one end of the second groove 82 communicates with the heat radiation portion, and the shaft has a third groove 83 which communicates with the other end of each of the first and second grooves 81 and 82.

In one form, the first groove 81 extends toward the outer peripheral surface of the heat absorption portion-side rotor 24 from the center portion thereof, and one end of the first groove 81 is opened toward the heat absorption portion. In another form, the second groove 82 extends toward the outer peripheral surface of the heat radiation portion-side rotor 23 from the center portion thereof, and one end of the second groove 82 is opened toward the heat radiation portion. In still another form, the third groove axially extends within the shaft 22, and communicates with the other ends of the first and second grooves 81 and 82. As illustrated in FIG. 8, the first, second, and third grooves 81, 82, and 83 may be configured as a plurality of first, second, and third grooves.

In accordance with the form illustrated in FIG. 8, the heat absorption portion and the heat radiation portion communicate with each other through a passage formed by the first, second, and third grooves 81, 82, and 83. Accordingly, unlike the form illustrated in FIGS. 2 and 3, in the form illustrated in FIGS. 7 and 8, the heat absorption portion and the heat radiation portion are not in direct contact with each other, but are spaced apart from each other. Therefore, the heat absorption portion and the heat radiation portion communicate with each other through only the passage formed by the first, second, and third grooves 81, 82, and 83.

As illustrated in FIG. 7, the Stirling engine may include an outer housing 15 which may cover the entirety of the heat absorption portion-side outer housing 11 and the heat radiation portion-side outer housing 12. In one form, a partition wall (not shown) for separation of the heat absorption portion and the heat radiation portion may be provided between the heat absorption portion and the heat radiation portion such that the heat absorption portion and the heat radiation portion do not communicate with each other through the passage formed by the first, second, and third grooves 81, 82, and 83.

Figure 4A:
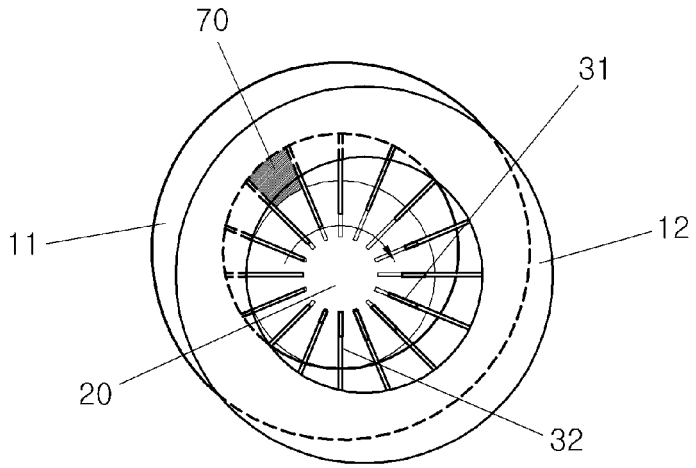
FIG. 4A to FIG. 4D are reference view illustrating the operation of the Stirling engine according to the form of the present disclosure.
Figure 4B:
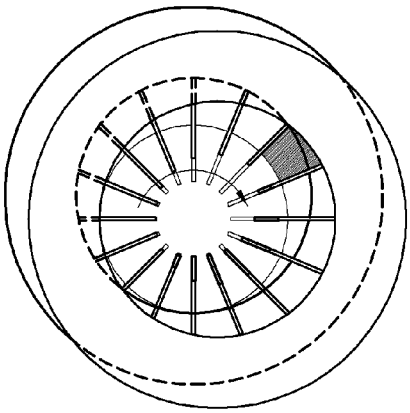
Figure 4C:
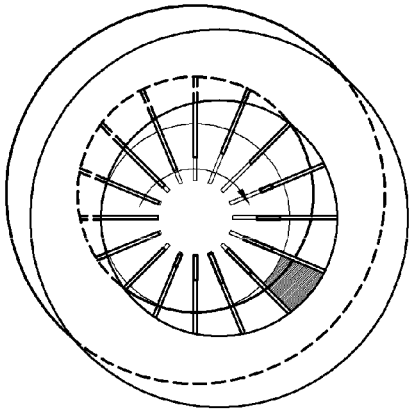

In the Stirling engine according to the form illustrated in FIGS. 7 and 8, in the constant volume heat radiation process illustrated in FIG. 4B, the heating medium 70 passes through the first groove 81 formed in the heat absorption portion-side rotor 24, the third groove 83 formed in the shaft 22, and the second groove 82 formed in the heat radiation portion-side rotor 23 in this order, so as to move from the heat absorption portion to the heat radiation portion.

Figure 4D:
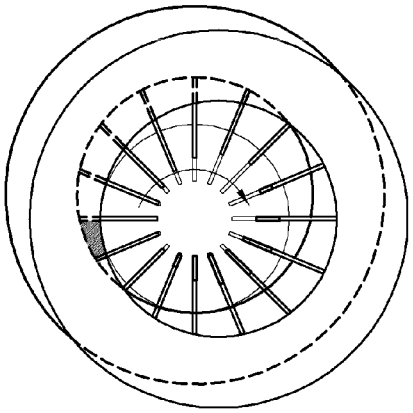

In addition, in the constant volume heat absorption process illustrated in FIG. 4D, the heating medium 70 passes through the second groove 82 formed in the heat radiation portion-side rotor 23, the third groove 83 formed in the shaft 22, and the first groove 81 formed in the heat absorption portion-side rotor 24, so as to move from the heat radiation portion to the heat absorption portion.

Since a Stirling engine according to the present disclosure may not need the reciprocating motion of a piston for generation of power, it is advantageous in noise and vibration compared to a conventional Stirling engine. In addition, since a heating medium moves between a heat absorption portion and a heat radiation portion in the same enclosed space within a housing, there is no concern that the heating medium is leaked between a piston and a cylinder.

Since the Stirling engine according to the present disclosure may not need complicated configurations such as pistons, cylinders, and connecting rods, compared to the conventional Stirling engine, it has a simple structure. Thus, the Stirling engine can be compact and manufactured at low cost, compared to the conventional Stirling engine.

Since the Stirling engine according to the present disclosure may not need intake and exhaust valves, compared to the conventional Stirling engine, it has a simple structure, and it is possible to configure heat sources for heating the heat absorption portion in various manners.

While the present disclosure has been described with respect to the specific forms, it will be apparent to those skilled in the art that various changes and modifications may be made without departing from the spirit and scope of the present disclosure as defined in the following claims.

What is claimed is:

1. A Stirling engine comprising:

a housing for storing a heating medium in an internal space;

a rotor eccentrically disposed in the housing and having a plurality of vane slots;

a plurality of vanes inserted into the vane slots;

a heater configured to heat the heating medium in the housing;

a radiator configured to cool the heating medium in the housing; and an output shaft coupled to the rotor so as to output power to outside, wherein the internal space of the housing comprises:

a heat absorption portion as a space in which the heating medium is heated, and a heat radiation portion as a space in which the heating medium is cooled, wherein the plurality of vanes comprises heat absorption portion-side vanes, where one end of each of the heat absorption portion-side vanes is inserted into each of the vane slots, and another end of each of the heat absorption portion-side vanes comes into contact with an inner surface of the housing forming the heat absorption portion during rotation of the rotor, wherein heat radiation portion-side vanes are configured such that one end of each of the heat radiation portion-side vanes is inserted into each of the vane slots, and another end of each of the heat radiation portion-side vanes comes into contact with the inner surface of the housing forming the heat radiation portion during rotation of the rotor;

wherein the rotor is configured such that a heat absorption portion-side rotor into which the heat absorption portion-side vanes are inserted, a heat radiation portion-side rotor into which the heat radiation portion-side vanes are inserted, and a shaft connecting the heat absorption portion-side rotor to the heat radiation portion-side rotor along a longitudinal direction of the shaft are formed integrally with one another, wherein when the heat absorption portion-side rotor continuously rotates, the heating medium is heated and isothermally expanded between the heat absorption portion-side vanes, and radiates heat under a constant volume while moving from the heat absorption portion to the heat radiation portion, and wherein when the heat radiation portion-side rotor continuously rotates, the heating medium is isothermally compressed between the heat radiation portion-side vanes, and cooled in the heat radiation portion by the radiator, where the heating medium is configured to absorb heat under a constant volume while moving from the heat radiation portion to the heat absorption portion, thereby allowing power to be generated for rotation of the output shaft.

2. The Stirling engine of claim 1, wherein the housing comprises:

a heat absorption portion-side outer housing, wherein a first hole to be bounded by the heat absorption portion-side vanes is placed in the heat absorption portion-side outer housing;

a heat radiation portion-side outer housing, wherein a second hole to be bounded by the heat radiation portion-side vanes is placed in the heat radiation portion-side outer housing; and outer housings configured to cover the first and second holes the outside, respectively, wherein the heat absorption portion-side outer housing comes into contact with the heat radiation portion-side outer housing such that the heat absorption portion directly communicates with the heat radiation portion, when the rotor rotates, the another end of each of the heat absorption portion-side vanes come into contact with a wall surface of the first hole, and the another end of each of the heat radiation portion-side vanes come into contact with a wall surface of the second hole.

3. The Stirling engine of claim 2, wherein shapes of first and second holes are formed so as to dispose the rotor eccentrically in the heat absorption portion and the heat radiation portion.

4. The Stirling engine of claim 1, wherein the heat absorption portion-side vanes and the heat radiation portion-side vanes are inserted into the same vane slots formed in the rotor.

5. The Stirling engine of claim 2, wherein the heater transfers heat to the heating medium through an outer housing for covering the heat absorption portion-side outer housing, and the radiator radiates heat from the heating medium through an outer housing for covering the heat radiation portion-side outer housing.

6. The Stirling engine of claim 2, wherein the first and second holes are arranged to have a predetermined phase angle difference.

7. The Stirling engine of claim 2, wherein each of the heat absorption portion-side outer housing, the heat radiation portion-side outer housing, and the outer housings have a plate shape, and wherein the heat absorption portion-side outer housing and heat radiation portion-side outer housing are stacked between the outer housings.

8. The Stirling engine of claim 1, wherein the heat absorption portion-side rotor has a first groove formed therein such that one end of the first groove communicates with the heat absorption portion, the heat radiation portion-side rotor has a second groove formed therein such that one end of the second groove communicates with the heat radiation portion, and the shaft has a third groove communicating with the another ends of the first and second grooves, and wherein when the heating medium radiates heat under a constant volume and absorbs heat under a constant volume, the heating medium moves between the heat absorption portion and the heat radiation portion according to the continuous rotation of the rotor through a passage formed by the first, second, and third grooves.

* * * * *